United States Patent [19]

Nielsen

[11] Patent Number: 4,520,943

[45] Date of Patent: Jun. 4, 1985

[54] RECLOSABLE PLASTIC CONTAINER

[76] Inventor: Jens O. Nielsen, Hvidhoj 2, DK-8870 Langaa, Denmark

[21] Appl. No.: 634,537

[22] Filed: Jul. 26, 1984

[30] Foreign Application Priority Data

Jul. 28, 1983 [DK] Denmark ..... 3449/83

[51] Int. Cl.[3] ..... B65D 43/04

[52] U.S. Cl. ..... 220/281; 220/306; 220/307

[58] Field of Search ..... 220/281, 306, 307, 315, 220/324, 326

[56] References Cited

U.S. PATENT DOCUMENTS 4,171,062 10/1979 Allen et al. ..... 220/306

4,335,827 6/1982 Knize et al. ..... 220/306

*Primary Examiner*—George T. Hall

*Attorney, Agent, or Firm*—Antonelli, Terry & Wands

[57] ABSTRACT

A bucket or jug shaped plastic container is provided with an annular groove in its upper mouth edge portion, and a lid having a depending edge flange is secured on the container by a double sided locking nose engagement between the lid flange and the walls of the groove. The locking engagement is very firm, but is easily releasable by urging the top edge of the outer container wall portion outwardly and downwardly about a lower annular hinge portion of reduced material thickness, whereby the upper locking part of the outer container wall portion is swung out of its locking engagement and down into a selfstabilized position. The locking engagement at the interior side of the lid flange is releasable simply by a local side pressure on the wall of the container, whereafter the lid can be drawn away. The container is reclosable by the lid, and the lid can be relocked by folding the said outer container wall portion up from its lowered position.

6 Claims, 5 Drawing Figures

RECLOSABLE PLASTIC CONTAINER

Figure 1:
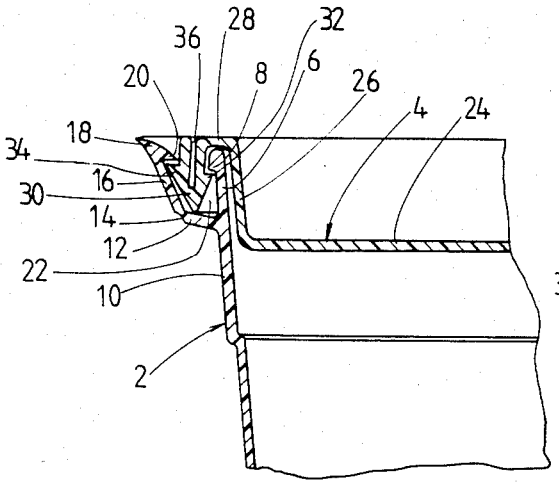

The present invention relates to a reclosable sales packing of the bucket or jug type, comprising a plastic container, the mouth edge portion of which is provided with an upper annular groove between an inner mouth flange and an outer mouth flange, and a lid having a depending edge flange, which is received in said edge groove so as to engage underneath an annular locking nose portion on the interior side of the outer mouth flange of the container and be inwardly supported by the exterior side of the inner mouth flange.

A packing of this type is known from No. DK-C-127.872, according to which the upper mouth portion of the container is provided with an annular outer flange portion as projecting, cross sectionally, outwardly and upwardly and having at its upper edge an inwardly and upwardly projecting locking nose portion, which cooperates with the top edge of the outer flange portion of a generally V-shaped locking flange as depending from the edge of the lid, while the innermost side of the V-shaped lid flange is radially inwardly supported against a smooth outside of the innermost mouth flange portion of the container. The top edge of the outer mouth flange portion can be forced resiliently outwardly sufficiently for releasing its locking engagement with the outer flange portion of the depending lid flange, whereafter the lid can be drawn off the container. With such a design a reasonably good locking of the lid is achievable without the lid being too difficult to remove or reclose.

However, a still better locking of the lid would be desirable, particularly in case of liquid filled containers, because in handling and shipping the non-rigid packings may be exposed to side pressures and impacts giving rise to high internal pressures and deformations of the engagement area between the container and the lid. It has already been proposed to effect an almost complete locking of the lid, e.g. with the use of an additional locking nose engagement between the inside of the depending lid flange and the outside of the inner mouth flange portion of the container, but it has been an associated disadvantage that the lid should then be opened by cutting or rupturing inside the locking edge thereof, whereby the packing is not of the reclosable type, at least not reclosable with the same lid.

It is the purpose of the invention to provide a packing of the type first referred to, which is improved with respect to the locking of the lid and yet still easy to open and reclose.

According to the invention this is achieved by designing the package as stated in the charaterizing clause of claim 1. The invention is based on the recognition that the use of an additional locking engagement along the outside of the inner mouth flange of the container will greatly contribute to the locking of the lid without making the lid difficult to remove, because when the outer mouth flange of the container is outwardly and downwardly foldable it is thereafter. i.e. upon such folding, operable to transfer a local, inwardly directed pressure to the inner mouth flange of the container, whereby, due to the resiliency of the plastic container wall, the relevant inner mouth flange portion will be displaced inwardly and thus be eased out of its locking engagement with the inner locking nose portion of the depending lid flange.

The folding down of the outer mouth flange of the container can be effected locally with a finger tip, which is also used for then exerting a radially inwardly directed pressure on the folded down mouth flange, hereby effecting the said release of the interior locking engagement just inside the position of the finger tip. In this position the finger tip will also be in engagement with the outer edge of the lid as unlocked and exposed by the folding down of the outer mouth flange, and since the relevant lid edge area is now unlocked at both sides of the depending lid flange it will be sufficient to lift the finger tip for easily lifting up the lid edge from the engagement area. Once a local lid edge area has thus been lifted from its engagement with the locking mouth groove of the container the remainder of the lid periphery is easy to release by pulling up the lid from the already released portion thereof.

In a preferred embodiment of the invention the outer mouth flange of the container is designed so as to be foldable over an integral annular hinge portion of reduced material thickness, such that the flange is self-stabilized in its folded down position. The flange is easily pressed down into this position all the way around the container mouth, whereafter the flange is generally inoperative. The lid is then easily releasable, both because its outer edge can be gripped locally and tilted out of its locking engagement with the inner mouth flange of the container and because it can be locally released from this engagement by the user exerting a radially inwardly directed pressure generally on an upper side wall portion of the container so as to cause an inward displacement, locally, of the inner mouth flange portion of the container in order to release the interior locking engagement.

Figure 2:
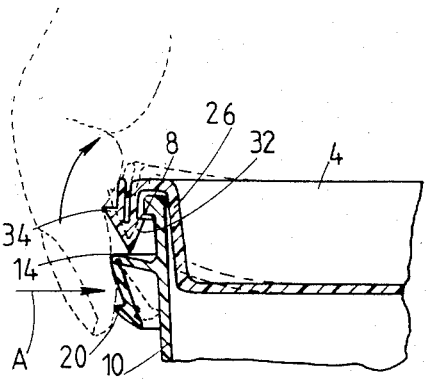
Figure 3:
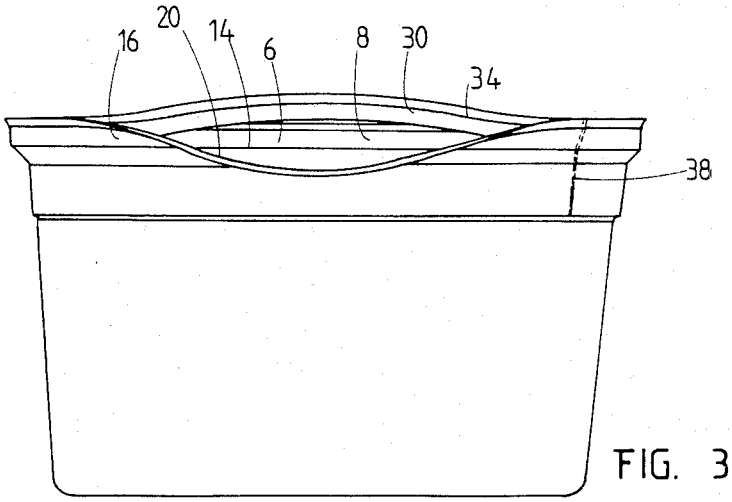
Figure 4:
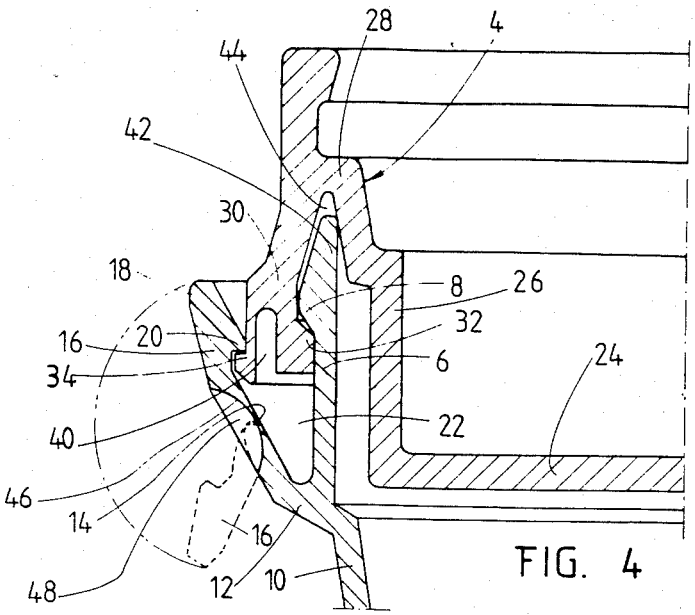
Figure 5:
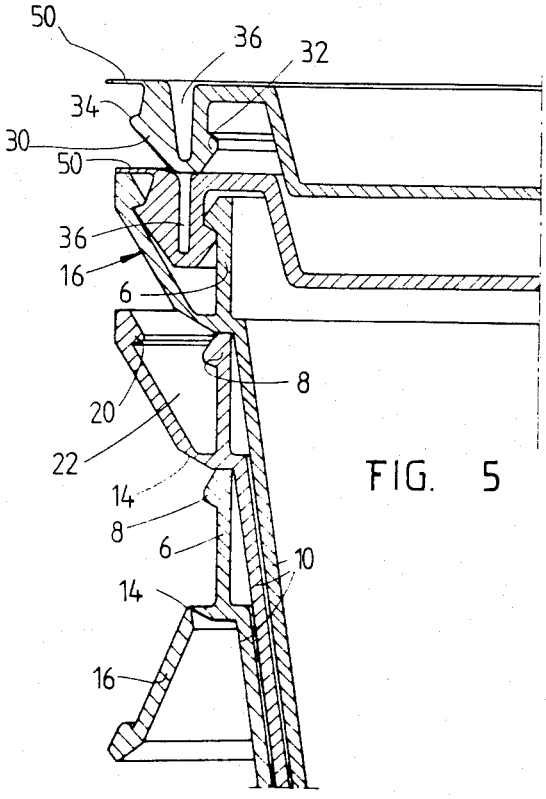

In the following the invention is described in more detail with reference to the drawing, in which:

FIG. 1 is a cross sectional view of the upper left corner of a packing according to the invention, FIG. 2 is a similar view upon folding down of the outer mouth flange of the container, FIG. 3 is a side view of the top portion of the packing, during opening thereof, FIG. 4 is a cross sectional view, corresponding to FIG. 1, of a modified package, and FIG. 5 is a corresponding view of further modified packings and lids as shown in a piled configuration.

In FIG. 1 is shown the upper left corner of a packing comprising a bucket or jug shaped container 2 of plastic as closed by a lid 4 also of plastic. The container 2 has an upper and inner mouth flange portion 6, the top end of which has an outwardly projecting nose portion 8. The mouth flange portion 6 is an upper continuation of a side wall 10 of the container 2, and on the outside thereof is provided an outwardly directed flange portion 12, which continues, through an annular hinge area 14 of reduced material thickness, in an upwardly projecting outer mouth flange portion 16 the top end portion of which, designated 18, is provided with an inwardly protruding nose portion 20. Thus, between the inner and the outer mouth flanges 6 and 16, respectively, is defined an upwardly open groove 22 in the upper edge portion of the container 2.

The lid 4 has a central plate portion 24 which, near the edge of the lid, has an upstanding flange portion 26 as continuing in an upper horizontal portion 28 associated with an outer, depending flange 30 of the lid 4. The depending flange 30 has an inner nose portion 32 engaging underneath the nose 8 of the inner mouth flange 6 of the container and an outer nose portion 34 engaging underneath the nose 20 of the outer mouth flange 16.

The edge flange 30 is downwardly pointed and is provided with an upwardly open, narrow groove 36, which projects downwardly beyond the levels of the lid noses 32 and 34.

Due to the pointed configuration of the lid flange 30 and the resiliency of the plastic material the lid 4 is easily forced down into its closed position on the container 2, and with the bilateral locking of the lid flange 30 the lid will be widely secured against unintended opening by internal or external forces.

For opening the container it is sufficient to push downwardly on the upper edge portion 18 of the outer mouth flange 12,16 by means of a fingertip, whereby the upper flange portion 16 will initially disengage the locking nose 34 and then pivot about the hinge area 14 to the position shown in FIG. 2, then to exert an inward side pressure on the folded down flange portion 16 as indicated by an arrow A, whereby the locking engagement between the inner locking noses 8 and 32 will get released, and thereafter or almost at the same time to lift the finger tip as already engaging the outer edge of the lid (see FIG. 2), whereby the relevant lid portion is lifted beyond the locking level of the inner locking nose 8. In practice, due to its resiliency, the lid portion will almost by itself, upon its release, seek to a position, in which the lower edge of the lid flange 30 rides on the top edge of the inner mouth flange 6, as also illustrated in FIG. 3. The raised lid edge portion is now easily grasped and pulled further upwardly, whereby the remainder of the lid edge is willingly released as by zip lock action.

Though it would be acceptable that the outer flange portion 16 would automatically return into its initial position when released by the fingertip, it is nevertheless highly advantageous that this flange portion will, for obvious reasons, be self holding in its folded down position. It is easy to fold down all the way round, before or after removal of the lid, and thereafter the lid is conveniently usable for simple reclosing of the container with the aid of the inner locking nose engagement 8,32. It will of course also be possible to relock the lid, simply by folding the outer flange portion 16 up into its initial position.

It should be mentioned that a considerable inwardly directed pressure on the container wall will be automatically created by the folding of the outer flange portion 16, because of the associated increase of the radius of the outermost flange portion 18,20 and the corresponding peripheral stetching of the material, particularly when the flange portion passes through a horizontal position in level with the hinge portion 14. This side pressure may be more than enough to cause the described disengagement between the locking noses 8 and 32, and especially for large size packings with a heavier design of the lid locking system it would be possible to avoid the complete downfolding of the flange 16, as there would be sufficient space to enable the lid edge to be gripped and lifted already by a pressing down of the flange 16 to adjacent its said horizontal position.

In heavy designs the flange 16 may be difficult to fold out, and it will facilitate the folding if at one or more places the flange 16 is provided with a vertical split as indicated at 38 in FIG. 3.

FIG. 4 shows a modified embodiment, particularly with a modified design of the lid. However, the main portions of FIGS. 1-3 are refound in FIG. 4 and designated by the same reference numerals. An exeption is the lid groove 36, which is in FIG. 4 substituted by a downwardly open groove 40. The inner mouth flange 6 has an upper extension 42, which seals against a wall portion of a groove 44 between the lid portions 30 and 26. This engagement does not prevent the release of the locking engagement between the inner noses 8 and 32 by the described side pressure on an underlying part of the container wall, because the flange 6 will be able to tilt about its top end to allow for retraction of the locking nose 8 anyway.

In FIG. 4 the hinge area 14 is located at the bottom of an outer, wide recess 46, and at some or many places along this annular recess is provided a thinwalled leaf member 48 with vertical orientation and generally filling out the cross section of the recess 46. These leaf of fin members 48 as provided integrally with the outer mouth flange 12,14,16 will get severely damaged or deformed by the folding out or down of the flange portion 16, such that it can be visually inspected whether or not the pacing has been previously opened. This will amount to a so-called security seal, since the packing is at least quite difficult to open without folding the flange portion 16 outwardly.

FIG. 5 illustrates an embodiment which is only slightly different from FIG. 1-3, and again similar reference numerals are used for similar parts. FIG. 5 shows three piled containers, of which the uppermost is closed by a lid, on which is piled another lid, whereby also piling of containers and lids is illustrated. FIG. 5 shows one major modification, viz. the outer top edge corner of the lid being provided with a radially outwardly projecting flange 50 of a very small thickness. In use, when the container is closed in a filling plant, the flange 50 will be located just on the top of the outer mouth flange 16 of the container as a final closing action the flange 50 is joined with this top edge by welding, which can be done with a very simple welding equipment. Hereby is provided a so-called guarantee sealing, as the packing cannot be opened without breaking the sealing flange. On the other hand, the flange is very easy to break or cut for normal opening. The flange 50 should not necessarily be fully annular, as it may be sufficient to arrange for a number of individual small width flange portions or sealing tongues, e.g. at five or more places along the lid edge.

A comparison between the two lids of FIG. 5 will show that the groove 36 is narrowed when the lid is mounted on its container. Thus, the depending lid edge flange 30 has a cross resiliency of its own, which is believed to be important, in practice, for a good locking and sealing as well as for tolerance adaption.

I claim:

1. A sales packing of the bucket or jug type, comprising a plastic container, the mouth edge portion of which is provided with an upper annular groove between an inner mouth flange and an outer mouth flange, and a lid having a depending edge flange, which is received in said edge groove so as to engage underneath an annular locking nose portion of the interior side of the outer mouth flange of the container and be inwardly supported by the exterior side of the inner mouth flange, characterized in that additional cooperating locking nose means are provided on the outside of the inner mouth flange of the container and on the inside of the depending edge flange of the lid, respectively, and that the outer mouth flange of the container is designed so as to be outwardly and downwardly foldable into a swung down position, in which a local, radially inwardly directed pressure thereon will result in the inner mouth flange of the container being resiliently inwardly displaced so as to thereby get released from its locking nose engagement with the edge flange of the lid.

2. A packing according to claim 1, in which the outer mouth flange of the container is connected with the wall of the container through an annular hinge area of reduced material thickness such that the outer mouth flange is self stabilized in its folded down position.

3. A packing according to claim 1, in which the outer mouth flange or at least the upper part hereof is axially split at one or more places.

4. A packing according to claim 1, in which the depending lid edge flange is provided with an annular groove, which is open either downwardly or preferably upwardly.

5. A packing according to claim 1, in which the outside of the outer mouth flange is provided with a number of thinwalled fin portions extending generally radially and axially across the folding area of the said flange so as to be breakable or visually deformable by the downfolding of the upper part of the outer mouth flange of the container.

6. A packing according to claim 1, in which the lid is provided with one or more radially outwardly projecting, thin flange portions, which engage the top side of the outer mouth flange and is or are secured thereto by welding or otherwise so as to form an easily breakable guarantee seal.

* * * * *